United States Patent [19]

Strickler et al.

[11] Patent Number: 4,684,042

[45] Date of Patent: Aug. 4, 1987

[54] CONTAINER AND FOLLOW PLATE ASSEMBLY USABLE WITH VISCOUS MATERIAL DISPENSERS HAVING RECEIVING PORTS OF TWO DIFFERENT SIZES

[76] Inventors: James E. Strickler; Jeffrey E. Strickler, both of P.O. Box 1828, York, Pa. 17405

[21] Appl. No.: 848,498

[22] Filed: Apr. 7, 1986

[51] Int. Cl.[4] ..... B65D 47/36

[52] U.S. Cl. ..... 222/327; 222/386; 222/541; 222/545; 206/77.1; 220/93

[58] Field of Search ..... 222/325, 326, 327, 383, 222/386, 390, 181, 185, 256, 257, 260, 541, 545; 206/77.1, 384; 220/93, 276, 265, 281; 221/302

[56] References Cited

U.S. PATENT DOCUMENTS

| | | | |
|---|---|---|---|
| 2,301,933 | 11/1942 | Eberhart | 222/386 X |
| 2,393,217 | 1/1946 | Brewton | 222/386 X |
| 2,453,274 | 11/1948 | Serowy | 220/93 |
| 4,437,589 | 3/1984 | Potter | 222/327 |
| 4,506,784 | 3/1985 | Kanfer | 222/327 X |

*Primary Examiner*—Joseph J. Rolla
*Assistant Examiner*—Edward S. Ammeen
*Attorney, Agent, or Firm*—Charles J. Long

[57] ABSTRACT

A container and follow plate assembly for highly viscous materials such as hand cleaner is selectively usable with dispensing devices having receiving ports of larger and smaller sizes. The preferably cylindrical container, which is sized so that one end fits the larger port, has a removable cover at that end and a fixed member closing the second end. The fixed member inlcudes a removably covered discharge opening therein which fits the smaller port. The follow plate, a one piece, preferably circular dish which is closely spaced from the inside of the container, is positioned adjacent the discharge opening end when the container is filled. The follow plate includes an integral but removable section aligned with and larger than the discharge opening.

3 Claims, 11 Drawing Figures

CONTAINER AND FOLLOW PLATE ASSEMBLY USABLE WITH VISCOUS MATERIAL DISPENSERS HAVING RECEIVING PORTS OF TWO DIFFERENT SIZES

BACKGROUND OF THE INVENTION

1. Field of the Invention

This invention relates generally to containers received by wall-mounted dispensing devices and used to contain highly viscous material, such as hand cleaner, for dispensing from the dispensing devices. More particularly, the invention relates to a container assembly adapted to be received selectively by either of two such dispensing devices having receiving ports of different sizes.

2. Description of Related Art

Known in the prior art are several arrangements for dispensing viscous fluids such as hand cleaner. One component of each such arrangement is a dispensing device, generally a plastic or metal mechanism intended to be mounted on a wall or similar surface. The other component is a container filled with the material to be dispensed; the container is normally cylindrical in shape and has a removable top cap or member covering an opening which fits on the dispensing device.

A first type of dispensing device employs a spring-loaded reciprocal arm moved by hand pressure to open and close a valve to permit metered amounts of the material to pass out of a nozzle. To affix the cylindrical container to this first type of dispensing device the top cap is removed and the container is inverted into a suitable receiving port on the dispensing device. Receiving ports on such dispensing devices may be any of several different diameters, two popular ones being about $5\frac{1}{4}$ and about 3 inches respectively.

In order for the material to flow suitably when the container is installed on the first type of dispensing device, it is necessary to provide within the container and resting on the surface of the material a follow or pressure plate having its periphery closely spaced from the container sides; it is also necessary to provide means allowing air into the space above the follow plate. In prior art containers having a diameter matching the receiving port on the dispensing device with which they are used, common practice has been to insert the follow plate in the bottom of the container prior to filling. Then, when the top cap is removed and the container is inverted on the dispensing device, an opening is provided in the bottom of the container to allow air to enter.

Where the receiving port in the first type of dispensing device is of smaller diameter than the container, a suitably sized opening is formed in the container bottom and a removable cap inserted therein. The container is then filled from the open top and a full-diameter top cap is affixed. In use, the bottom cap is removed and the container is positioned on the dispensing device port. The top cap is then removed and a separate follow plate, generally supplied by the manufacturer of the dispensing device, is positioned on the surface of the material being dispensed; often the top cap is repositioned loosely over the open end of the container to keep foreign material out while allowing air to enter the container.

With the first type of dispensing device, a combination of atmospheric pressure acting on the follow plate and the pumping action of the dispensing device itself will provide a measured amount of material to the user.

A second type of dispensing device includes a threaded center post and a ratchet-gear arrangement. A pressure plate is carried on the threaded post which is actuated by the ratchet gearing from a handle. Moving the handle turns the threaded post, which draws the pressure plate down onto the material and forces the material out of a dispensing valve. A typical container used heretofore with the second type of dispensing device is cylindrical and has a knock-out plug centrally disposed in the bottom wall so that the container, once its top cap has been removed, can be inserted over the threaded shaft, following which the pressure plate is mounted on the threaded post and brought into contact with the material, so that actuation of the handle and working of the ratchet gearing draws the pressure plate down and forces the material out of the dispensing nozzle or valve.

Potter U.S. Pat. No. 4,437,589 discloses a container in which the bottom wall has a reduced thickness web at its circumference adjacent the sidewall juncture, whereby after the container is inverted and mounted on the dispensing device, the entire bottom wall can be separated from the container and act as the inside follow plate; in such configuration the top cap, which has been removed to mount the container on the dispensing device, can then be loosely positioned over the bottom (actually the top when the container is inverted) to prevent dirt or other foreign material from falling into the container. Potter's bottom wall also has a reduced diameter centrally located knock-out section defined by a circumferential reduced thickness web, enabling the container to be used with the second type of dispensing device described above.

Although the container of Potter U.S. Pat. No. 4,437,589 is usable with both the first and second above described types of dispensing devices, the configuration of its bottom wall and top cap can be expected to make it difficult and expensive to fabricate.

As previously mentioned, two popular dispensing devices of the first type have have receiving port diameters of about $5\frac{1}{4}$ inches and about 3 inches respectively. Obvious advantages accrue with an inexpensive container assembly usable with receiving ports of both sizes as well as with dispensing devices of the second type described above.

SUMMARY OF THE INVENTION

We have developed a container assembly which can be used with all the above discussed dispensing devices.

In accordance with the broadest aspects of the invention, we provide a container assembly for highly viscous material and adapted to be received selectively by first and second dispensing devices having receiving ports of different sizes, comprising an elongate sidewall enclosing a contained volume of substantially uniform cross section, the sidewall having first and second ends and a cross-sectional size and shape which fits the receiving port of the first dispensing device; a first removable member closing the first end; a second member fixed to and extending across the second end, the second member having a discharge opening therein of a size and shape which fits the receiving port of the second dispensing device; a removable cover for the discharge opening; and a follow plate within and in closely spaced relationship with the sidewall, the follow plate being adjacent to the second member when the container is filled with contents to be dispensed, the follow plate having a removable section aligned with and of larger size than the discharge opening, the removable section adapted to be removed when the discharge opening is used to dispense contents.

In a preferred embodiment, we provide a cylindrical container assembly for highly viscous material and adapted to be received selectively by first and second dispensing devices having circular receiving ports of larger and smaller diameters respectively, comprising an elongate cylindrical sidewall having first and second ends and a diameter which fits the receiving port of the first dispensing device; a first removable member closing the first end; a second member fixed to and extending across the second end, the second member having a circular discharge opening therein of a diameter which fits the receiving port of the second dispensing device; a removable cover for the discharge opening; and a circular follow plate within and in closely spaced relationship with the cylindrical sidewall, the follow plate being adjacent to the second member when the container is filled with contents to be dispensed, the follow plate having a removable circular section concentric with and of larger diameter than the discharge opening, the removable section adapted to be removed when the discharge opening is used to dispense contents.

For best results with the preferred cylindrical embodiment, the sidewall inside diameter is $D_1$, the follow plate diameter is $D_2$, $D_2$ is less than $D_1$, the discharge opening diameter is $D_3$, and the removable section diameter is at least $D_3$ plus $(D_1-D_2)/2$.

Preferably, in the cylindrical embodiment, the follow plate and removable section thereof are constructed from a single disk of material, the disk being perforated in a circular pattern which defines the periphery of the removable section, the removable section including a diametrical fold line of reduced thickness, whereby pressure applied to the edge of the removable section at diametrically opposite points 90 degrees from the fold line causes the removable section to separate from the disk and fold along the fold line, whereby passage of the removable section through the discharge opening in the second member is facilitated.

BRIEF DESCRIPTION OF THE DRAWINGS

In the accompanying drawing figures we have shown a present preferred embodiment of the invention in which.

DESCRIPTION OF THE PREFERRED EMBODIMENT

Figure 1:
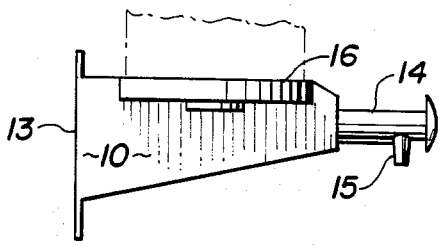
FIG. 1 is a side elevational view of a dispensing device of the first type having a large receiving port diameter.
Figure 2:
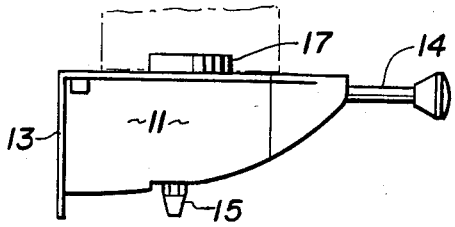
FIG. 2 is a side elevational view of a dispensing device of the first type having a smaller receiving port diameter.

Referring first to FIGS. 1 and 2, two common designs of dispensing devices of the first type described above are shown as 10 and 11 respectively. In use, the dispensing devices are commonly mounted on a wall or other vertical surface at 13. Each dispensing device includes a spring-loaded reciprocal arm 14 which when moved by hand to the left viewing FIGS. 1 and 2 opens a valve (not shown) to permit metered amounts of the dispensed material to pass out of a nozzle 15; release of hand pressure from the arm 14 permits the spring (not shown) to return the arm to the extended position shown in FIGS. 1 and 2. Device 10 has a circular receiving port 16 of relatively larger diameter, typically about $5\frac{1}{4}$ inches, and device 11 has a circular receiving port 17 of relatively smaller diameter, typically about 3 inches. Shown in phantom lines both FIG. 1 and FIG. 2 are the outlines of container assemblies mounted on the dispensing devices.

Figure 3:
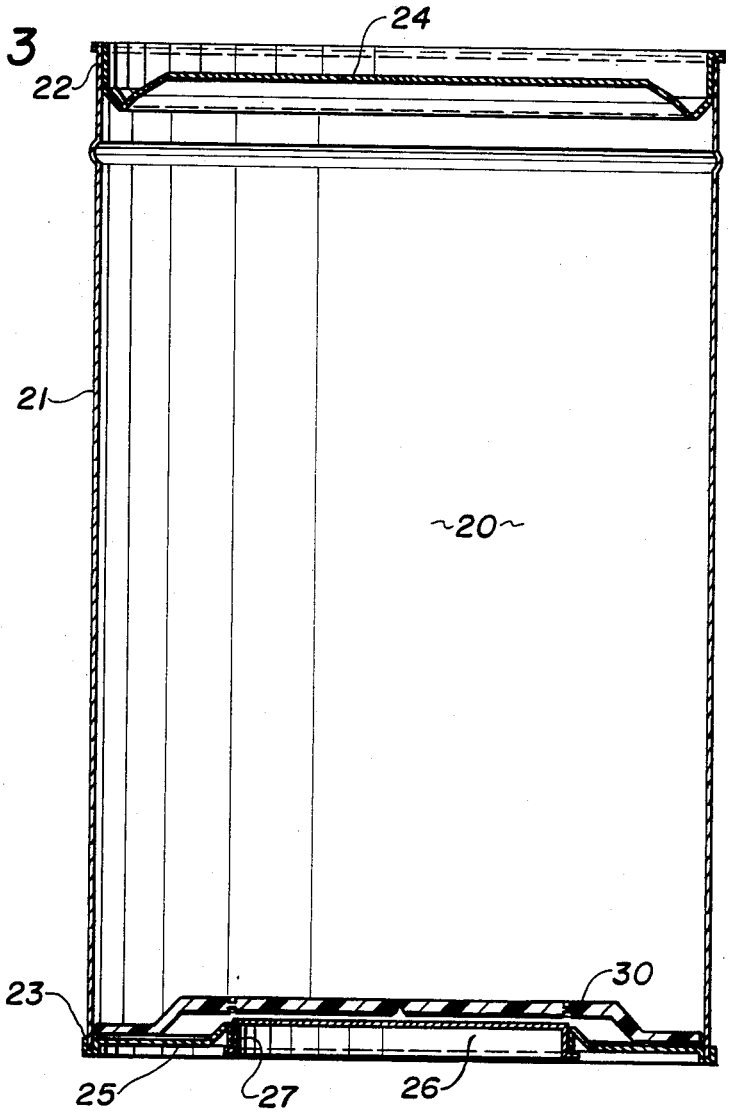
FIG. 3 is a vertical sectional view of a container assembly according to the invention, having the follow plate in position adjacent the second member at the bottom.

In FIG. 3 is shown in vertical cross section a preferred embodiment of a cylindrical container assembly 20 according to the invention. The assembly, which is empty in FIG. 3, includes an elongate cylindrical sidewall 21 having first and second ends 22 and 23 respectively. Sidewall 21 is typically fabricated from sheet metal of the type used in "tin" cans or the like and its outside diameter is such that it will fit receiving port 16 on dispensing device 10 of FIG. 1. A first removable member or lid 24 fits tightly within the first end 22 so as to close it. A second member 25, fixed as by soldering or crimping, extends across the second end 23 of sidewall 21. The second member 25 has a circular discharge opening 26 therein, the diameter of which fits snugly on the receiving port 17 of dispensing device 11 in FIG. 2. A removable cover 27 fits tightly in discharge opening 26. Lid 24, member 25 and cover 27 are all typically fabricated from sheet metal such as that used for sidewall 21. Within and closely spaced from sidewall 21 is a circular follow plate 30, discussed more fully hereinbelow. It should be noted that although the preferred embodiment of the invention is cylindrical in shape, the invention has equal applicability to container assemblies and dispensing device receiving ports of shapes other than circular.

As depicted in FIG. 3, the container assembly 20 is in position to be filled with material to be dispensed, such as hand cleaner. With lid 24 removed, filling is done from the top viewing FIG. 3 and then lid 24 is inserted in end 22. It will be seen that follow plate 30 is adjacent to the second member 25 when the container assembly is filled with contents, for reasons which will become evident hereinbelow.

Figure 4:
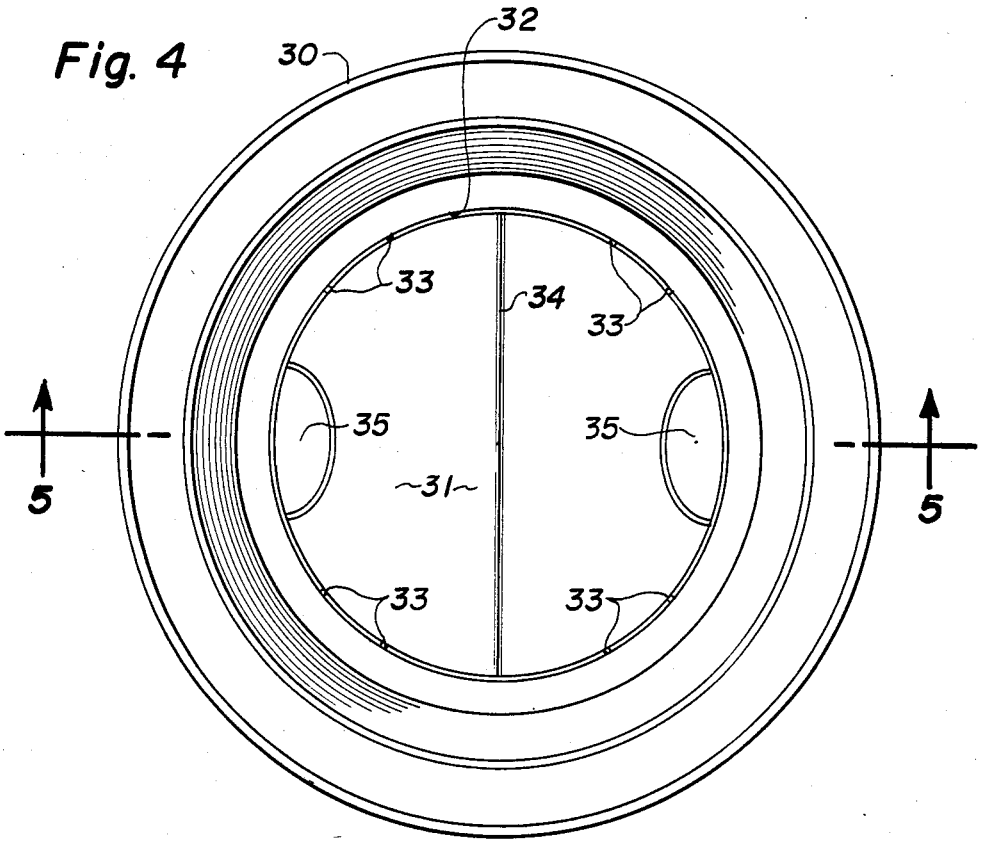
FIG. 4 is a full size plan view of a preferred follow plate.
Figure 5:
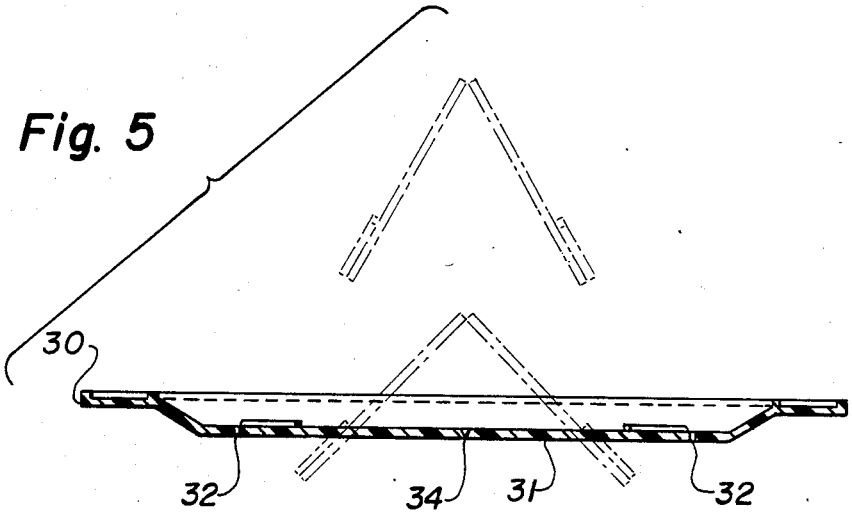
FIG. 5 is a sectional view taken on the line 5—5 of FIG. 4 and showing, in phantom, how the removable section is removed.

Turning now to FIGS. 4, 5, and 6, there is shown in more detail a preferred follow plate 30 according to the invention. Follow plate 30 is circular in shape and of slightly smaller diameter than the inside diameter of cylindrical sidewall 21 of FIG. 3, thereby putting follow plate 30 in closely spaced relationship to sidewall 21 while allowing it to move freely in the cylinder's axial direction. Although a flat follow plate will function acceptably, plate 30 is dished in the center so that its center rests on the raised inner surface of cover 27 when its periphery is resting on the inner surface of fixed member 25. The preferred dished shape of follow plate 30 maximizes the volume available within the container assembly for material to be dispensed, and prevents unwanted separation of the removable section 31 under pressure of the material when the assembly is full.

At the center of follow plate 30 is a removal circular section 31, the diameter of which is larger than the diameter of discharge opening 26 in member 25 so that when opening 26 is fitted over a dispensing device receiving port (as shown FIG. 8 and discussed more fully hereinbelow), the edge of the opening in follow plate 30 created by removal of section 31 will not catch on the receiving port wall. In order to allow for possible lateral movement of follow plate 30 permitted by the clearance between the edge of plate 30 and the inside of cylindrical sidewall 21, we have found that for best results the following diameter relationships are preferred: if the inside diameter of sidewall 21 is $D_1$, the diameter of follow plate 30 is $D_2$, $D_2$ being less than $D_1$, and the diameter of discharge opening 26 is $D_3$, the minimum diameter of removable section 31 should be $D_3$–$D_2$)/2.

Maximum diameter of the removable section 31 is dictated by the practical consideration that it should be removable without significant disturbance of the material to be dispensed when the container assembly is filled with said material—i.e., when follow plate 30 is adjacent member 25 at end 23 of sidewall 21. In general, we prefer to keep the diameter of removable section 31 at or near the above-defined minimum.

Figure 7:
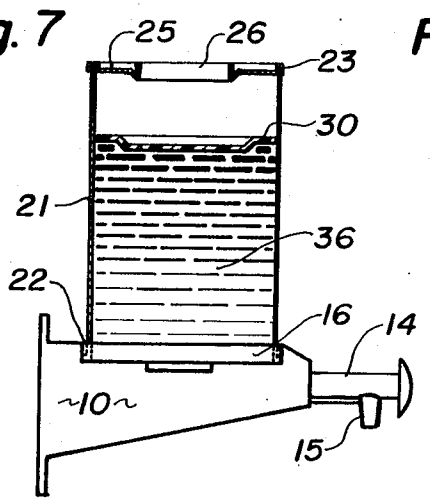
FIG. 7 is a schematic illustration of the assembly of FIG. 3 mounted on the dispenser of FIG. 1.
Figure 6C:
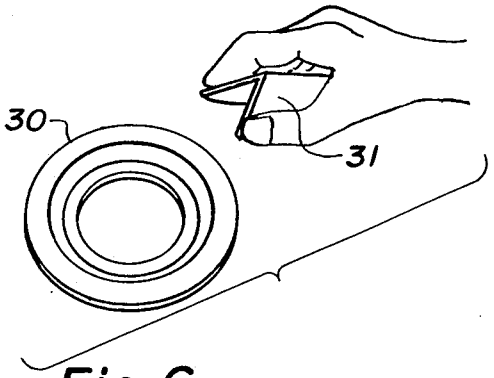
FIGS. 6*a*, 6*b* and 6*c* show in sequence the removal of the removable section of the follow plate of the invention.
Figure 6B:
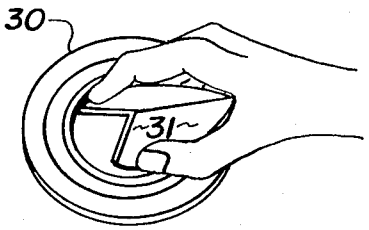
Figure 6A:
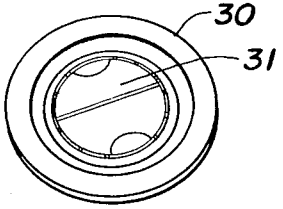

The preferred follow plate embodiment shown in FIGS. 4, 5, and 6 is constructed from a single disc of a material which will not be adversely affected by contact with the material to be dispensed. Although numerous materials could be used for the follow plate, we prefer to use high-impact polystyrene when hand cleaner is the material to be dispensed. In fabrication, the follow plate disc 30 is perforated in a circular pattern which defines the periphery of removal section 31. As shown in FIG. 4, our preferred perforation pattern provides a narrow circumferential opening 32 spanned by four evenly spaced pairs of narrow webs 33 of reduced thickness. The width of opening 32 is limited by the necessity to minimize incursion of air through follow plate 30 when it is used intact on the top surface of material being dispensed, e.g. as shown in FIG. 7; we have found that satisfactory results are obtained if opening 32 is no more than about 0.020 inches wide. In order to further facilitate removal of section 31 from follow plate 30, we also provide a diametrical fold line 34 of reduced thickness. When follow plate 30 is constructed as shown in FIGS. 4 and 5, removable section 31 can be readily removed by applying pressure, e.g. with the thumb and forefinger, to peripheral sites 90° removed from fold line 34, indicated by semi-circular ridges 35 in FIG. 4; application of such pressure both separates section 31 from follow plate 30 and folds section 31 for easy withdrawal. Removal of removable section 31 is shown in hatched lines in FIG. 5 and sequentially in FIGS. 6*a*, 6*b*, and 6*c*.

Figure 9:
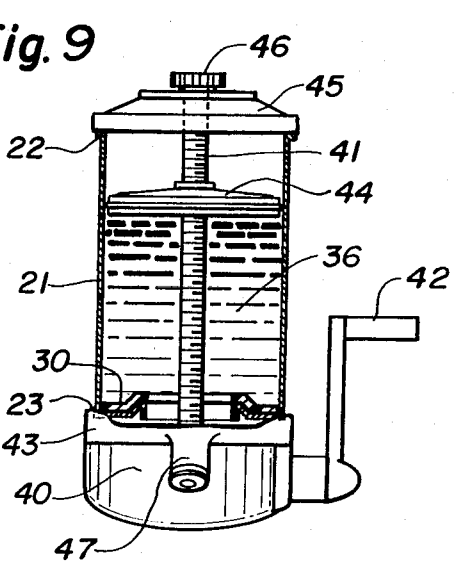
FIG. 9 is a schematic illustration of the assembly of FIG. 3 mounted on a dispenser of the second type.
Figure 8:
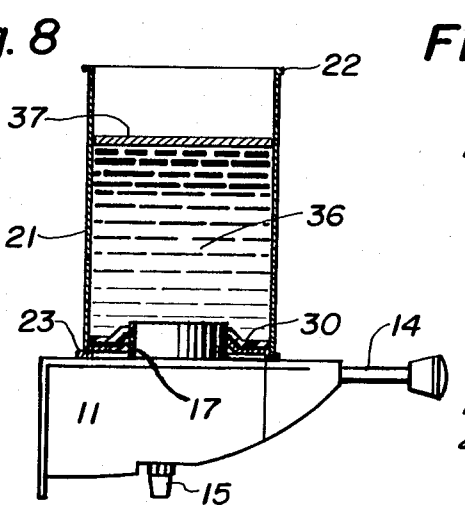
FIG. 8 is a schematic illustration of the assembly of FIG. 3 mounted on the dispenser of FIG. 2.

FIGS. 7 and 8 show how a container assembly according to the invention can be used with either of the dispensing devices of FIGS. 1 and 2 having receiving ports of two different sizes, and FIG. 9 shows how our container assembly can be used with a dispensing device of the second above-described type. In all the drawing figures the material to be dispensed 36 is shown in hatched lines partially filling the container assembly, although it will be understood that the interior is normally completely filled prior to use.

In FIG. 7, the container assembly of FIG. 3 is used with dispensing device 10 having a receiving port 16 with a large diameter which accommodates the diameter of sidewall 21. In mounting it on receiving port 16, the container assembly is positioned with end 22 at the top, lid 24 is removed from end 22 and the assembly is then inverted and end 22 placed within receiving port 16. When the assembly is in position cover 27 is removed from discharge opening 26 thereby allowing atmospheric pressure to act on follow plate 30 to maintain consistent flow of the material 36 as dispensing takes place. If desired, cover 27 can be left loosely in place on opening 26 to prevent foreign matter from falling into the container assembly; however, this has not been done in FIG. 7. In the arrangement of FIG. 7, follow plate 30 is used intact—i.e., removable section 31 is not removed—so that it can function as a follow plate.

In FIG. 8, the receiving port 17 of dispensing device 11 is of smaller diameter matching the size of discharge opening 27 in container assembly of FIG. 3. When mounting the assembly on device 11, the assembly is first positioned with end 23 at the top. Cover 27 is removed, then removable section 31 of follow plate 30 is removed as illustrated in FIG. 6, thereby exposing the surface of material 36. The assembly is then inverted and discharge opening 26 fitted down over receiving port 17, the walls of port 17 extending up past the inner edge of follow plate 30 and into the material 36. Thereafter, lid 24 is removed from end 22 of the container assembly and a separate follow plate 37 is placed within sidewall 21 and resting on the surface of material 36. Follow plate 37 is generally supplied with the dispensing device 11 and is intended to be transferred from one container assembly to the next, when the former has been emptied. To prevent foreign material from falling into the container assembly, lid 24 can if desired be loosely repositioned on the open end 22 of the assembly after follow plate 37 has been inserted; however, this has not been done in FIG. 8.

FIG. 9 shows a front view of the container assembly of FIG. 3 mounted on a dispensing device 40 of the second type discussed above. Device 40 includes a threaded center post 41 and a ratchet-gear arrangement, now shown, operated by a handle 42. To mount the container assembly on device 40, cover 27 is removed from discharge opening 26 and section 31 is removed from follow plate 30. The container assembly is then positioned with discharge opening 26 down and moved down over the center post 41 into a receiving sleeve 43 of device 40; lid 24 is removed when the upper end of center post 41 contacts it during this process. When the container assembly is in position a pressure plate 44 is threaded down on to center post 41 until it contacts the top surface of material 36, following which a cover 45 is positioned over the open top of the container assembly and held in place by a nut 46 threaded on the top of center post 41. Means are provided to minimize turning of pressure plate 44 when center post 41 rotates, so that rotation of center post 41 will cause downward movement of pressure plate 44. When assembled, activating handle 42 in the appropriate direction causes center post 41 to rotate and draw pressure plate 44 down on the material 36, which forces material 36 out through a nozzle 47 on the front of the device.

From the foregoing it can be seen that a single container assembly according to the invention can be used successfully both with dispensing devices of the first type having two different receiving port sizes and with dispensing devices of the second type. Since nearly all current hand cleaner dispensing devices of the first type have one of the two standard receiving port sizes mentioned above, our container assembly is of essentially universal utility in the hand cleaner dispensing field. Further, fabrication of our container assemblies is simple and inexpensive, so that they can be discarded after their contents have been used.

While we have shown and described a certain present preferred embodiment of the invention, it is to be distinctly understood that the invention is not limited thereto but may be otherwise variously embodied within the scope of the following claims.

We claim:

1. A container and follow plate assembly for highly viscous material and adapted to be received selectively by first ans second dispensing devices having receiving ports of different sizes, comprising an elongate sidewall enclosing a contained volume of substantially uniform cross-section, the sidewall having first and second ends and a cross-sectional size and shape which fits the receiving port of the first dispensing device; a first removable membeer closing the first end; a second member fixed to and extending across the second end, the second member having a discharge opening therein of a size and shape which fits the receiving port of the second dispensing device; a removable cover for the discharge opening; and a follow plate within and in closely spaced relationship with the sidewall, the follow plate being adjacent to the second member when the container is filled with contents to be dispensed, the follow plate being constructed from a single piece of material and having an integral but removable section aligned with and of larger size than the discharge opening, the removable section adapted to be removed when the discharge opening is used to dispense contents.

2. A cylindrical container and follow plate assembly for highly viscous material and adapted to be received selectively by first and second dispensing devices having circular receiving ports of larger and smaller diameters respectively, comprising an elongate cylindrical sidewall having first and second ends and a diameter which fits the receiving port of the first dispensing device; a first removable member closing the first end; a second member fixed to and extending across the second end, the second member having a circular discharge opening therein of a diameter which fits the receiving port of the second dispensing device; a removable cover for the discharge opening; and a circular follow plate within and in closely spaced relationship with the cylindrical sidewall, the follow plate being adjacent to the second member when the container is filled with contents to be dispensed, the follow plate being constructed from a single disk of material and having an integral but removable circular section concentric with and of larger diameter than the discharge opening, the removable section adapted to be removed with the discharge opening is used to dispense contents.

3. A cylindrical container assembly for highly viscous material and adapted to be received selectively by first and second dispensing devices having circular receiving ports of larger and smaller diameters respectively, comprising an elongate cylindrical sidewall having first and second ends and a diameter which fits the receiving port of the first dispensing device; a first removable member closing the first end; a second member fixed to and extending across the second end, the second member having a circular discharge opening therein of a diameter which fits the receiving port of the second dispensing device; a removable cover for the discharge opening; and a circular follow plate within and in closely spaced relationship with the cylindrical sidewall, the follow plate being adjacent to the second member when the container is filled with contents to be dispensed, the follow plate having a removable circular section concentric with and of larger diameter than the discharge opening, the removable section adapted to be removed when the discharge opening is used to dispense contents, the follow plate and removable section being constructed from a single disk of material which is perforated in a circular pattern defining the periphery of the removable section, the removable section including a diametrical fold line of reduced thickness, whereby pressure applied to the edge of the removable section at diametrically opposite points 90° from the fold line causes the removable section to separate from the disk and fold along the fold line, thereby facilitating passage of the removable section through the discharge opening in the second member.

* * * * *

UNITED STATES PATENT AND TRADEMARK OFFICE

CERTIFICATE OF CORRECTION

PATENT NO. 4,684,042

DATED August 4, 1987

INVENTOR(S) James E. Strickler and Jeffrey E. Strickler

It is certified that error appears in the above-identified patent and that said Letters Patent are hereby corrected as shown below:

In line 10 of the Abstract, delete "dish" and substitute --disk--therefor.

In column 5, line 24, delete "$D_3-D_2)/2$" and substitute --$D_3+(D_1-D_2/2)$--therefor.

In column 7, line 21, delete "ans" and substitute--and--therefor.

In column 7, line 27, delete "membeer" and substitute --member--therefor.

In column 8, line 15, delete "with" and substitute--when--therefor.

Signed and Sealed this

Twenty-fourth Day of November, 1987

*Attest:*

*Attesting Officer*

DONALD J. QUIGG

*Commissioner of Patents and Trademarks*